US011230801B2

(12) United States Patent
Endle et al.

(10) Patent No.: US 11,230,801 B2
(45) **Date of Patent: *Jan. 25, 2022**

(54) SCOURING ARTICLE AND METHODS OF MAKING AND USING

(71) Applicant: 3M INNOVATIVE PROPERTIES COMPANY, St. Paul, MN (US)

(72) Inventors: James P. Endle, New Richmond, WI (US); John M. Brandner, Saint Paul, MN (US); Lauren K. Carlson, Saint Paul, MN (US); Robert J. Maki, Hudson, WI (US); Stephen M. Sanocki, Hudson, WI (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/594,855

(22) Filed: Oct. 7, 2019

(65) Prior Publication Data

US 2020/0040497 A1 Feb. 6, 2020

Related U.S. Application Data

(63) Continuation of application No. 15/119,396, filed as application No. PCT/US2015/016046 on Feb. 16, 2015, now Pat. No. 10,435,827.

(Continued)

(51) Int. Cl.
*D04H 1/64* (2012.01)
*D04H 1/54* (2012.01)

(Continued)

(52) U.S. Cl.
CPC ..... *D04H 1/64* (2013.01); *A47L 13/16* (2013.01); *A47L 17/00* (2013.01); *A47L 23/04* (2013.01);

(Continued)

(58) Field of Classification Search
CPC ... D04H 1/54; D04H 1/58; D04H 1/64; A47L 13/16; A47L 17/00; A47L 23/04; B08B 1/001

See application file for complete search history.

(56) References Cited

U.S. PATENT DOCUMENTS 2,757,150 A * 7/1956 Heritage ..... C08L 2666/02 523/326
2,958,593 A ‡ 11/1960 Hoover ..... B24D 18/0036 51/295

(Continued)

FOREIGN PATENT DOCUMENTS

DE 102008051317 ‡ 4/2010
EP 1764077 ‡ 3/2007

(Continued)

OTHER PUBLICATIONS

International Search Report for PCT International Application No. PCT/US2015/016046, dated May 28, 2015, 3pgs.‡

(Continued)

*Primary Examiner* — Pegah Parvini
*Assistant Examiner* — Ross J Christie
(74) *Attorney, Agent, or Firm* — Vincent Pham

(57) ABSTRACT

A scouring article including a monolithic nonwoven pad with a semi-densified fibrous layer that is integral to the monolithic nonwoven pad and that provides a major surface of the monolithic nonwoven pad, and methods of making and using.

19 Claims, 3 Drawing Sheets

Related U.S. Application Data

(60) Provisional application No. 61/940,580, filed on Feb. 17, 2014.

(51) Int. Cl.

| | |
|---|---|
| ***A47L 13/16*** | (2006.01) |
| ***A47L 23/04*** | (2006.01) |
| ***D04H 1/58*** | (2012.01) |
| ***A47L 17/00*** | (2006.01) |
| ***B08B 1/00*** | (2006.01) |

(52) U.S. Cl.
CPC ..... *B08B 1/001* (2013.01); *D04H 1/54* (2013.01); *D04H 1/58* (2013.01)

(56) References Cited

U.S. PATENT DOCUMENTS 4,142,334 A ‡ 3/1979 Kirsch ..... A47L 13/16 451/53
4,355,489 A ‡ 10/1982 Heyer ..... B24D 3/002 451/53
4,600,620 A ‡ 7/1986 Lloyd ..... A47L 13/17 428/19
5,213,588 A ‡ 5/1993 Wong ..... A47L 13/17 51/293
5,227,229 A ‡ 7/1993 McMahan McCoy .. D04H 1/64 15/229
5,310,590 A ‡ 5/1994 Tochacek ..... D04H 1/52 428/10
5,346,516 A 9/1994 Alkhas et al.
5,498,478 A * 3/1996 Hansen ..... A61F 13/531 428/357
5,626,512 A ‡ 5/1997 Palaikis ..... D04H 1/60 451/53
5,685,935 A ‡ 11/1997 Heyer ..... A47L 17/08 156/17
5,858,140 A * 1/1999 Berger ..... B24D 11/005 156/62.2
5,955,177 A ‡ 9/1999 Sanocki ..... C03C 25/42 428/21
6,312,484 B1 ‡ 11/2001 Chou ..... B24D 3/002 51/295
6,833,014 B2 ‡ 12/2004 Welygan ..... B24D 3/002 51/293
7,232,364 B2 ‡ 6/2007 Hibbard ..... A47L 13/17 15/104
7,393,371 B2 ‡ 7/2008 O'Gary ..... B24D 3/002 51/293
7,517,556 B2 ‡ 4/2009 Johnson ..... A47L 13/16 427/19
7,829,478 B2 ‡ 11/2010 Johnson ..... A47L 13/16 442/10
8,162,152 B2 ‡ 4/2012 Omori ..... A61M 1/3627 156/60
8,162,153 B2 ‡ 4/2012 Fox ..... B01D 39/163 210/49
8,343,882 B2 ‡ 1/2013 Johnson ..... A47L 13/16 428/14
10,435,827 B2 * 10/2019 Endle ..... A47L 23/04
2003/0003836 A1 ‡ 1/2003 Schindler ..... A47L 13/16 442/41
2003/0031703 A1 ‡ 2/2003 McMeekin ..... A45D 44/00 424/44
2003/0121530 A1 ‡ 7/2003 Borgonjon ..... A47L 13/17 134/6
2003/0124935 A1 ‡ 7/2003 Smith ..... D06N 3/183 442/23
2004/0038613 A1 ‡ 2/2004 Mann ..... B24B 29/02 442/41
2004/0121686 A1 ‡ 6/2004 Wong ..... A47L 13/16 442/32
2006/0286884 A1 ‡ 12/2006 Thioliere ..... A47L 13/16 442/31
2007/0049169 A1 ‡ 3/2007 Vaidya ..... B24B 37/205 451/6
2007/0298697 A1 ‡ 12/2007 Charmoille ..... B24B 7/186 451/42
2009/0110890 A1 ‡ 4/2009 Garza ..... A47L 13/04 428/21
2010/0310837 A1 * 12/2010 Bond ..... D04H 3/16 428/196
2012/0017937 A1 * 1/2012 Sabade ..... A47L 13/12 134/6
2012/0064324 A1 ‡ 3/2012 Arellano ..... D04H 1/58 428/22
2012/0094091 A1 ‡ 4/2012 van Mil ..... D06P 1/44 428/19
2013/0337714 A1 ‡ 12/2013 Shah ..... D04H 3/147 442/35

FOREIGN PATENT DOCUMENTS

JP H08-318470 A 12/1996
JP 2004-142066 A 5/2004
WO WO 1994-04738 3/1994
WO WO1994-04738 ‡ 3/1994
WO WO 98/53956 12/1998
WO WO98/53956 ‡ 12/1998
WO WO 2003-104544 A 12/2003
WO WO 2004-097095 A 11/2004
WO WO 2004-106002 A 12/2004
WO WO 2005-113195 A 12/2005
WO WO 2006-071301 A 7/2006
WO WO 2007-139097 A 12/2007
WO WO2010/056835 ‡ 5/2010
WO WO 2010-056835 5/2010
WO WO 2011-008481 A 1/2011
WO WO 2012-006300 1/2012
WO WO2012-006300 ‡ 1/2012
WO WO2013-101575 ‡ 7/2013
WO WO 2013-101575 7/2013
WO WO2014-008049 ‡ 1/2014
WO WO 2014-008049 1/2014

OTHER PUBLICATIONS

Supplementary EP Search Report, EP 15748752, dated Jul. 12, 2017 (5 pages).‡
Translation of Notice of Reasons for Refusal in corresponding Japanaese Patent Application No. 2016-569572 of U.S. Appl. No. 15/119,396.‡
Translation of Notice of Reasons for Refusal in corresponding Japanese Patent Application No. 2016-569572 of U.S. Appl. No. 15/119,396.

* cited by examiner
‡ imported from a related application

SCOURING ARTICLE AND METHODS OF MAKING AND USING

CROSS REFERENCE TO RELATED APPLICATIONS

This application is a Continuation of U.S. application Ser. No. 15/119,396, filed Aug. 17, 2016, which is a National Stage filing under 35 U.S.C. 371 of PCT/US2015/016046, filed Feb. 16, 2015, which claims the benefit of U.S. Provisional Application No. 61/940,580, filed Feb. 17, 2014, the disclosure of which is incorporated by reference in its entirety herein.

BACKGROUND

Nonwoven articles are often used for cleaning various surfaces, e.g. food-contacting surfaces and the like.

SUMMARY

In broad summary, herein is disclosed a scouring article comprising a monolithic nonwoven pad that comprises at least a first semi-densified fibrous layer that is integral to the monolithic nonwoven pad and that provides a first major surface of the monolithic nonwoven pad. These and other aspects, including methods of making and using the article, will be apparent from the detailed description below. In no event, however, should this broad summary be construed to limit the claimable subject matter, whether such subject matter is presented in claims in the application as initially filed or in claims that are amended or otherwise presented in prosecution.

BRIEF DESCRIPTION OF THE DRAWINGS

Like reference numbers in the various figures indicate like elements. Some elements may be present in identical or equivalent multiples; in such cases only one or more representative elements may be designated by a reference number but it will be understood that such reference numbers apply to all such elements. FIGS. 1-4 are not to scale and are chosen for the purpose of illustrating different embodiments of the invention. In particular the dimensions of the various components are depicted in illustrative terms only, and no relationship between the dimensions of the various components should be inferred from FIGS. 1-4. Although terms such as "top", bottom", "upper", lower", "under", "over", "front", "back", "up" and "down", and "first" and "second" may be used in this disclosure, it should be understood that those terms are used in their relative sense unless otherwise noted. As used herein, the term "inward" means toward an imaginary plane located in the center of an article, along an axis that is generally oriented along the shortest dimension (i.e., the thickness dimension rather than the length or width dimension) of the article. The term "outward" means a direction generally away from such a plane. As used herein as a modifier to a property or attribute, the term "generally", unless otherwise specifically defined, means that the property or attribute would be readily recognizable by a person of ordinary skill but without requiring absolute precision or a perfect match (e.g., within +/−20% for quantifiable properties). The term "substantially", unless otherwise specifically defined, means to a high degree of approximation (e.g., within +/−10% for quantifiable properties) but again without requiring absolute precision or a perfect match. Terms such as same, equal, uniform, constant, strictly, and the like, are understood to be within the usual tolerances or measuring error applicable to the particular circumstance rather than requiring absolute precision or a perfect match.

DETAILED DESCRIPTION

Figure 1:
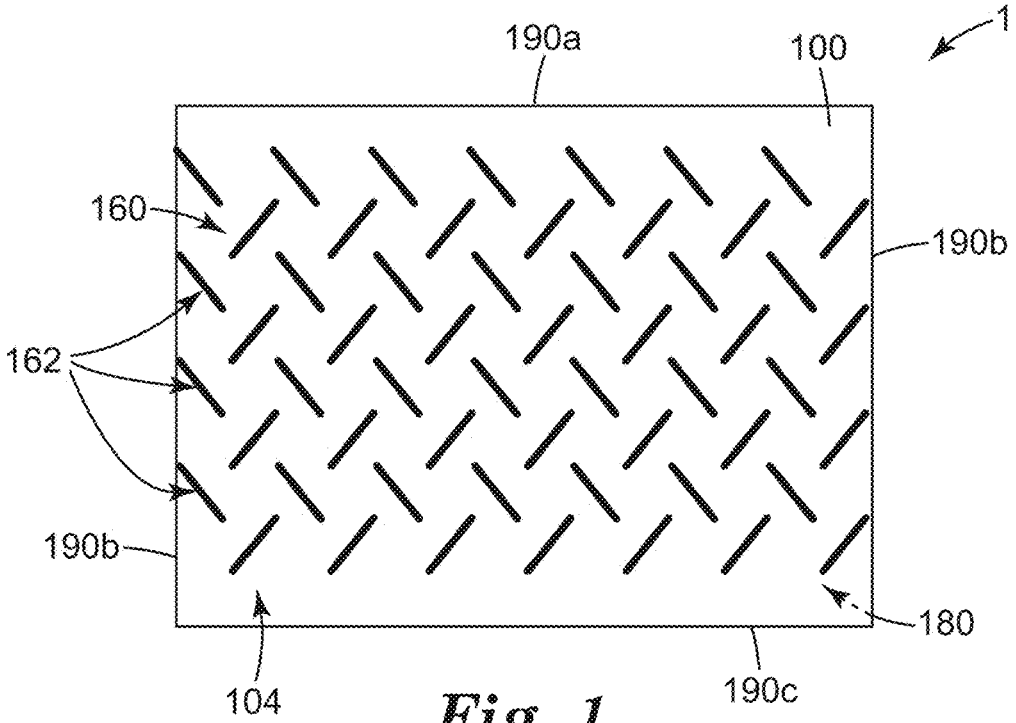
FIG. 1 is a top view of an exemplary scouring article as disclosed herein.

Shown in FIG. 1 is a top view of an exemplary scouring article 1. By a scouring article is broadly meant any article that comprises, on at least a first surface major of the article, an array 160 of scouring bodies 162, which scouring bodies 162 are configured such that when first surface 104 of article 1 is brought into contact with a surface (e.g., a food-contacting surface) and moved about the surface, the scouring bodies 162 can dislodge items that are present on (e.g., adhered to) the surface.

Figure 2:
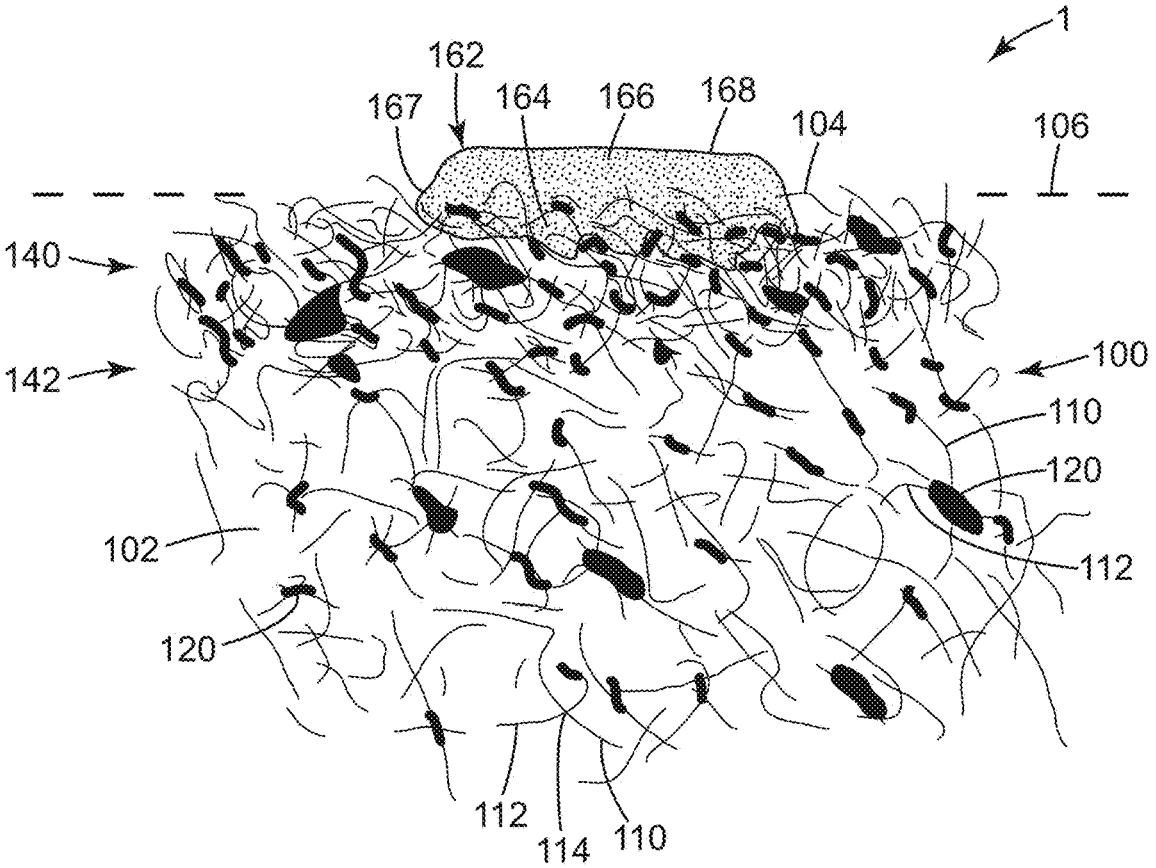
FIG. 2 is side schematic view of a portion of an exemplary scouring article as disclosed herein.
Figure 3:
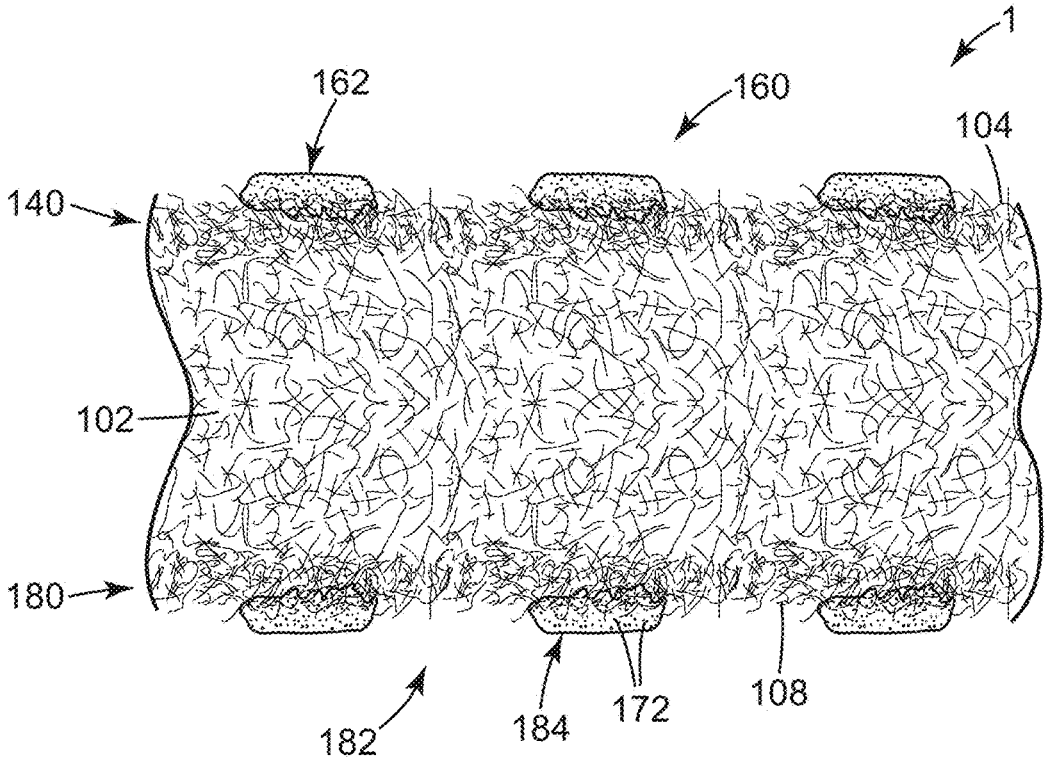
FIG. 3 is a side schematic view of a portion of another exemplary scouring article as disclosed herein.

Scouring article 1 comprises monolithic nonwoven pad 100, which comprises an interior 102, a first major surface 104, and a second major surface 108, as most easily seen in FIGS. 2 and 3. Nonwoven pad 100 may be any suitable nonwoven web, e.g. an airlaid web, a carded web, a melt-spun web, a stitchbonded web, a wetlaid web, a meltblown web, and so on. By monolithic is meant that the composition of pad 100 (i.e., in terms of the percentage of fibers of various compositions that are present) is at least substantially the same throughout the thickness of pad 100, including major surfaces 104 and 108 (noting that this does not preclude the collective density at which such fibers are present from differing throughout the thickness of pad 100, as discussed later in detail). By definition, the term monolithic does not encompass pads that are formed by laminating or otherwise attaching one nonwoven pad to another, even if such pads might be of similar or identical composition.

A monolithic nonwoven pad as described herein comprises at least some nonwoven fibers that are bonded to each other by fiber-fiber melt-bonding. Specifically, monolithic nonwoven pad 100 comprises at least some fiber-fiber melt-bonds throughout interior 102 of pad 100, as well as in semi-densified fibrous layer 140 that is described later herein. In some embodiments, at least some fibers of pad 100 may be staple fibers, which are defined herein as fibers that have been cut to an identifiable (e.g., predetermined) length. As such, staple fibers may be distinguished from fibers that are essentially continuous (e.g., meltspun fibers and the like). Staple fibers are typically formed and solidified and then cut to a length and then incorporated into a nonwoven web (as opposed to e.g. being directly collected as a web in the manner of e.g. meltspun or meltblown fibers). Any suitable staple fibers may be used, selected e.g. from synthetic fibers as well as naturally occurring fibers. Suitable synthetic fibers may include organic thermoplastic polymeric materials, which may be e.g. extruded, melt-spun, solvent-spun, and so on. Non-limiting examples of such materials may include e.g. polyamides such as polycaprolactam (nylon 6) and polyhexamethylene adipamide (nylon 6,6), polyolefins such as polypropylene and polyethylene, polyesters such as polyethylene terephthalate, acrylic fibers such as those formed from acrylonitrile, and so on. Other potentially suitable fibers include naturally occurring fibers such as those made from cotton, rayon, silk, jute, bamboo, sisal, wool, hemp, hog's hair, cellulose, and so on. Ceramic or metallic-based fibers may be used if desired. Any such fibers may be virgin fibers or may be reclaimed from e.g. garment cuttings, carpet manufacturing, fiber manufacturing, textile processing, and so on. Blends and mixtures of any suitable fiber types or compositions may be used. In some embodiments, at least some fibers of pad 100 may be first staple fibers 110 that exhibit a first melting point (which first melting point is higher than a second melting point of second staple fibers, if present, as discussed below). Such first staple fibers 110 may impart pad 100 with e.g. stiffness, strength, loft, resiliency, and so on, and may be chosen e.g. from any of the above-listed fibers. In specific embodiments, first staple fibers 110 may be comprised of polyethylene terephthalate (PET), which term is broadly used to encompass any blend, copolymer, and the like that includes PET units.

In some embodiments, at least some fibers of pad 100 may be second fibers 112 that are binding fibers. In this context, a binding fiber is any fiber (e.g., staple fiber) that comprises at least one major component that exhibits a second melting point that is lower than the first melting point of first staple fibers 110. Such binding fibers (e.g. when heated and then cooled as described below) may provide melt-bonding between the binding fibers and the first staple fibers at points of contact therebetween (melt-bonding between the binding fibers themselves may also occur, of course). In some embodiments, such binding fibers may be bicomponent fibers (in accordance with common usage, this term does not limit a fiber to only two components, but rather encompasses multicomponent fibers of any desired number of components). Such bicomponent fibers include at least one component that exhibits a second melting point that is lower than the first melting point of the first staple fibers, and further include at least one additional component that exhibits a third melting point that is higher than the second melting point of the bicomponent fibers. Often, such a higher-melting component of such a bicomponent fiber may be present as a core of the fiber, with a lower-melting component being present as a sheath (although any suitable configuration, e.g. side-by-side, may be used). The third melting point may be, but does not necessarily have to be, similar in value to the first melting point of the above-described first staple fibers. In various specific embodiments, the higher-melting component of such bicomponent fibers may be chosen e.g. from polyesters (e.g., polyethylene terephthalate), poly(phenylene sulfides), polyamides (e.g., nylon), polyimide, polyetherimide or polyolefins (e.g., polypropylene). The lower-melting component of the bicomponent fibers may be chosen as desired. In many embodiments, such a component may be of generally similar chemical composition as the higher-melting component, but may be of a different crystalline structure, may have a higher amorphous polymer content, and so on, so as to exhibit a lower melting point. Or, a lower-melting point component of a bicomponent fiber may be of a different chemical composition from the higher melting point component of the bicomponent fiber. Such differences may range from e.g. the inclusion of monomer units into a copolymer material, to the use of a completely different polymeric material.

In some embodiments, second (binding) fibers 112 may be monocomponent fibers that exhibit a lower melting point than the first melting point of first fibers 110. The ordinary artisan will readily understand that binding fibers (whether monocomponent or bicomponent) will soften and e.g. at least partially melt when brought to a sufficiently high temperature. Such fibers may then melt-bond to fibers 110 (and/or to each other) upon cooling and resolidifying, thus serving to transform a mass of fibers into an at least partially self-supporting pad (which pad may be further strengthened by the use of a binder as discussed below). Monocomponent binding fibers may differ slightly from bicomponent binding fibers in that in some instances monocomponent binding fibers may melt so as to partially, almost completely, or completely lose their fibrous form in the bonding process, while bicomponent fibers usually at least partially retain their fibrous form due to the presence of the higher-melting component (e.g., in the fiber core). Either type of binding fiber may be used, alone or in combination.

Staple fibers 110 and/or binding staple fibers 112 may be crimped or uncrimped. The use of crimped fibers may advantageously enhance the loft and/or resiliency of nonwoven pad 100. Crimped fibers are readily available from many sources; or, any suitable fibers may be crimped by the use of a stuffer-box, gear crimpers or the like. If fibers are crimped, the degree of crimping may range from e.g. 2 to 12 crimps per centimeter. In various embodiments, crimped fibers may exhibit a crimp index (measured by the procedures outlined in U.S. Patent Application Publication 2007/0298697 to Charmoille, which is incorporated by reference herein for this purpose) of e.g. from about 35% to about 70%. Staple fibers (whether crimped or not) as used herein may be of any suitable length; e.g. from 0.5 to 15 centimeters. Staple fibers as used herein may be of any suitable denier; e.g. from about 1 to about 200. In specific embodiments, staple fibers (110 and 112) may each range from about 6 to about 20 in denier. Any such fibers may have any desired cross-sectional shape (e.g., circular, triangular, square, multi-lobed, hollow, channeled, and so on). In some embodiments, staple fibers (110 and 112) may be hydrophobic fibers rather than hydrophilic fibers. The ordinary artisan will understand that many conventional fibers (e.g., many polyesters, polyolefins, polyamides, and so on) are inherently hydrophobic in nature unless particular compositions and/or surface finishes are chosen.

Figure 4:
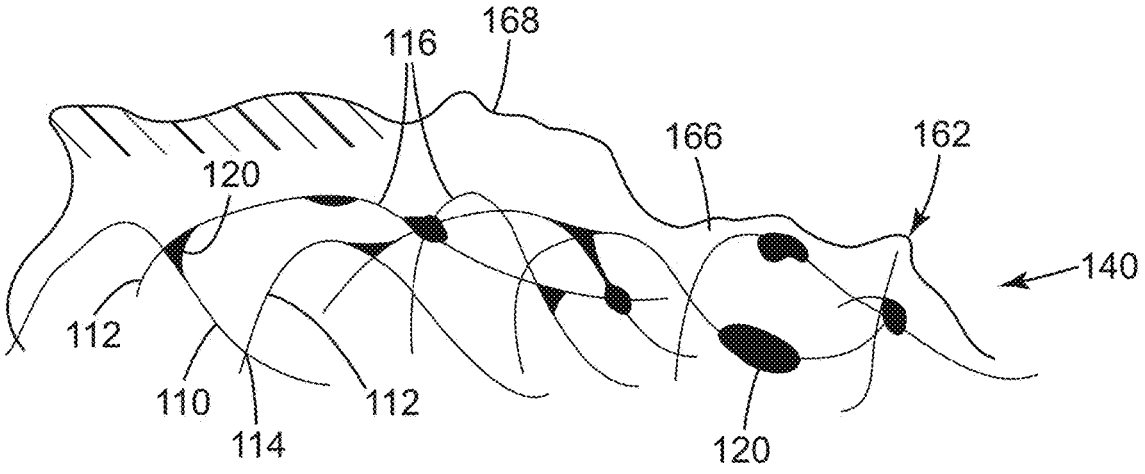
FIG. 4 is a side schematic view of an exemplary scouring body as disclosed herein.

Monolithic nonwoven pad 100 includes at least one binder 120 that is distributed throughout pad 100 (i.e., from major surface 104 to major surface 108, including the inwardmost portion of interior 102 of pad 100) in the form of globules at least some of which bind at least some of the fibers of the pad to other fibers of the pad. The term globule is used to broadly encompass a parcel of binder 120 of any shape or aspect ratio, noting that such globules do not necessarily have to be spherical or even approximately spherical in shape. Numerous globules of binder 120 are shown in exemplary representation in FIGS. 2 and 4. Although some globules may extend for a considerable length along fibers, and/or may contact other globules (e.g. so as to form an at least partial network of binder globules), an arrangement in which binder globules are distributed throughout pad 100 as described herein is distinguished from e.g. an arrangement in which the interstitial spaces of a nonwoven pad are completely filled with binder.

Often, binder globules 120 may be provided by way of impregnating a binder precursor into nonwoven pad 100, and then transforming the binder precursor into binder 120. Any suitable binder precursor may be used (noting that although in the art such materials are often referred to as binders, strictly speaking many of them are supplied in the form of a binder precursor that is transformed into the actual binder). In at least some embodiments, such a binder precursor may be provided in the form of a flowable material (e.g., a resin) that is impregnated into pad 100 and is then transformed into the binder by heat (whether by the promotion of cross-linking, the driving off of water and/or solvent, or by a combination of such mechanisms). In some embodiments, such a binder precursor may be provided as a flowable material (e.g. as a hot-melt binder precursor) that is impregnated into pad 10 and then cooled to transform it into the binder. A non-limiting list of suitable binder precursors includes e.g. acrylic resin, phenolic resin, nitrile resin, ethylene vinyl acetate resin, polyurethane resin, polyurea or urea-formaldehyde resin, isocyanate resin, styrene-butadiene resin, styrene-acrylic resins, vinyl acrylic resin, aminoplast resin, melamine resin, polyisoprene resin, epoxy resin, ethylenically unsaturated resin, and combinations thereof. The ordinary artisan will appreciate that such resins encompass both thermosetting and thermoplastic resins. In some embodiments, such a binder precursor may be conveniently applied e.g. as a mixture including water (e.g., as a latex) and may optionally include a crosslinker agent that promotes crosslinking of a polymer in the resin. Non-limiting examples of suitable binder precursors include, for example, Rovene 5900 available from Mallard Creek Polymers (North Carolina, USA), Rhoplex TR-407 manufactured and distributed by Dow Company (New Jersey, USA), and Aprapole SAF17 manufactured and distributed by AP Resinas (Mexico City, Mexico). Binders and binder precursors of various types are discussed in detail in U.S. Pat. No. 6,312,484 to Chou and in U.S. Patent Application Publication 20120064324 to Arellano, both of which are incorporated by reference in their entirety herein for this purpose (noting that Chou incorporates such binders into a slurry that is coated onto the surface of a nonwoven web rather than e.g. impregnating such binders completely through the thickness of a web).

As will be apparent from discussions herein, in many embodiments a primary function of binder 120 may be to enhance the strength of pad 100 (rather than e.g. to hold abrasive particles in place in or on pad 100). Thus, in some embodiments binder 120 may not include any abrasive particles of any kind (e.g., none of the oft-used inorganic abrasives such as aluminum oxide and so on). However, in other embodiments binder 120 may include abrasive particles (e.g., any of the abrasive particles listed later herein) if desired. Any filler, additive, processing aid, and the like, may be present in binder 120, as desired for any purpose.

Semi-Densified Fibrous Layer

Figure 5:
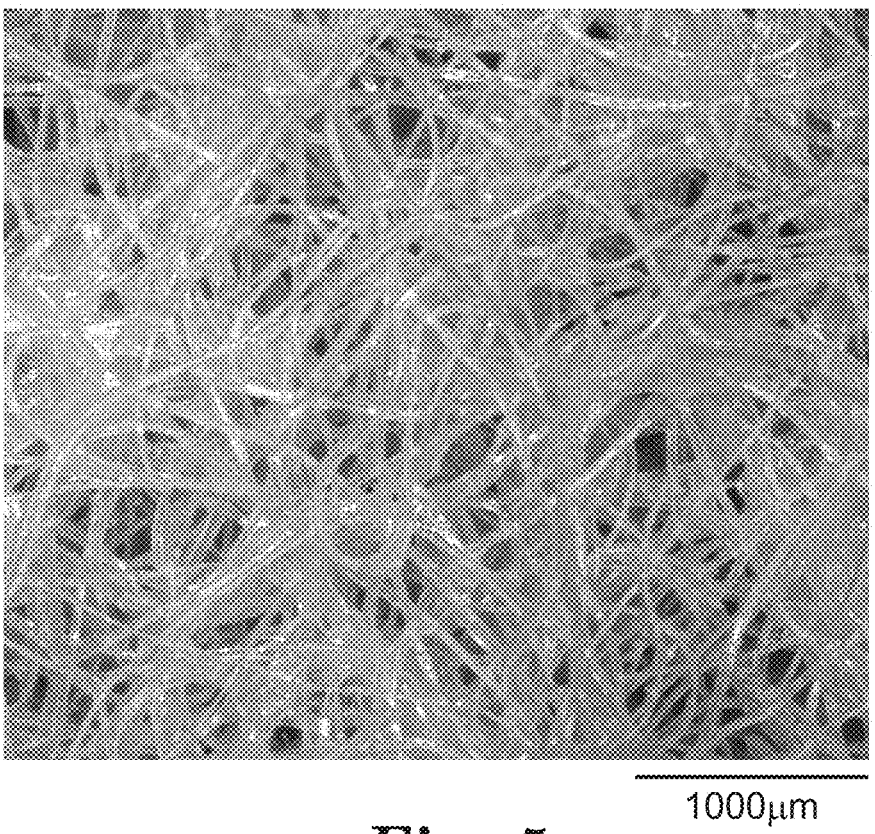
FIG. 5 is an optical micrograph of a major surface of an exemplary Working Example monolithic nonwoven pad as disclosed herein.

As seen in exemplary representation in FIGS. 2 and 3, monolithic nonwoven pad 100 comprises a first semi-densified fibrous layer 140. By "semi-densified" is meant that in layer 140, at least the fibers (e.g., fibers 110 and 112) are present at a higher volumetric density (i.e., in volume of fibers per volume of space) than they are in interior 102 of pad 100. Such an arrangement is shown in exemplary representation in FIG. 2. In at least some embodiments, binder 120 may also be present at a higher density in layer 140 than it is in interior 102 of pad 100, again as shown in exemplary representation in FIG. 2. The characterization of layer 140 as a "semi-densified fibrous" layer is used to emphasize that layer 140 at least generally retains its fibrous nature and is not densified or consolidated to the point of being a continuous (or even a significantly continuous) skin. This is illustrated in FIG. 5, which shows an experimentally obtained top view of a layer 140 of a representative Working Example nonwoven pad 100 and which confirms that layer 140 remains essentially fibrous and highly porous in nature. As such, layer 140 is distinguished from e.g. a continuous skin.

It will thus be appreciated that semi-densified fibrous layer 140 is not necessarily very different in character from interior 102 of pad 100; rather, the fibers and binder are merely present at a somewhat higher density in layer 140 than in interior 102. Nevertheless, the presence of semi-densified fibrous layer 140 can have profound and advantageous effects, as discussed later herein. In some cases this higher density may be characterized in terms of the "solidity" (which term is described in detail e.g. in column 3 lines 17-24 and column 11 line 50 through column 12 line 3 of U.S. Pat. No. 8,162,153 to Fox, which portion is incorporated by reference herein for this purpose) of layer 140 in comparison to the solidity of the interior 102 of pad 100. In various embodiments, layer 140 may exhibit a solidity that is at least about 10, 20, or 30% greater than the solidity of interior 102 of nonwoven pad 100. In further embodiments, layer 140 may exhibit a solidity that is at most about 120, 80, 60, or 40% greater than the solidity of interior 102 of nonwoven pad 100. In some cases, layer 140 may e.g. be so thin as to make it difficult to measure the solidity of layer 140 according to the procedures outlined in U.S. Pat. No. 8,162,152. In such cases, the solidity may be estimated e.g. by way of optical measurements, x-ray microtomography or the like.

Semi-densified fibrous layer 140 is integral with monolithic nonwoven pad 100 (meaning that at least some fiber segments that provide layer 140 are segments of fibers that have other segments that extend into interior 102 of pad 100) and comprises an outward major surface that provides first major surface 104 of pad 100. Often, layer 140 may extend inwardly from major surface 104 only a very short distance (often, less than about 200 microns) toward the interior of pad 100. In some embodiments, semi-densified fibrous layer 140 may extend inwards into pad 100 a distance that is no more than 10, 5, 2, 1, or 0.5% of the total thickness of pad 100 (with the total thickness of pad 100 being measured along the shortest dimension, between first and second major surfaces 104 and 108). In absolute terms, in various embodiments semi-densified fibrous layer 140 may extend inwards into pad 100 a distance that is no more than about 400, 200, 100, 40, or 20 microns. An inward boundary of semi-densified fibrous layer 140 may sometimes be easily visible, as denoted in FIG. 2 by reference number 142. However, while the transition between semi-densified fibrous layer 140 and the interior 102 of pad 100 may be fairly clear cut in some cases (as in the exemplary depiction of FIG. 2), it may be more gradual in other cases.

Scouring Bodies

First major surface 104 of nonwoven pad 100 comprises an array 160 of spaced-apart scouring bodies 162, as shown in exemplary representation in FIG. 1. By an array of spaced-apart bodies is meant that scouring bodies 162 collectively occupy less than about 50% of the area of major surface 104, such that exposed areas of surface 104 (as provided e.g. by outward fiber segments of the fibers of pad 100) are present between bodies 162. In various embodiments, scouring bodies 162 may collectively occupy less than about 40, 30, 20, or 10% of the area of major surface 104. In further embodiments, scouring bodies 162 may collectively occupy more than about 5, 10, 20, or 30% of the area of major surface 104. In various embodiments, array 160 may be configured so that bodies 162 are present as discrete islands (as in the exemplary illustration of FIG. 1) that do not contact each other, or as non-intersecting stripes, as a lattice of intersecting stripes, and so on. Any suitable pattern may be used, whether random or regular, repeating or non-repeating and so on. Individual bodies 162 may be of any desired shape (e.g., circular or generally-circular dots, squares, irregular shapes, and so on) and length/width aspect ratio (noting that the term stripe is not limited to straight-line shapes but rather encompasses any desired arcuate shape).

By a scouring body is meant that a body 162 includes at least one component with sufficient hardness to provide a scouring function. Such a component may be any suitable material with a Mohs hardness of at least 3, which materials will be referred to herein for convenience as abrasive materials (while the Mohs scale was originally developed for minerals, the ordinary artisan will appreciate that it is a straightforward scratch-resistance test that can be applied to any desired material). In some embodiments, such a component may be e.g. a particulate additive 172 that is combined with (e.g., mixed into) a precursor resin that is used to form a body 162, or that is dispersed onto a precursor resin after the resin is disposed on major surface 104. In some embodiments such a particulate additive may be any of the well-known inorganic materials (i.e., abrasive particles) that exhibit a Mohs hardness in the range of e.g. 8 to 10 (e.g., aluminum oxide, silicon carbide, alumina zirconia, ceria, cubic boron nitride, diamond, garnet, any suitable ceramic, and combinations of the foregoing). In other embodiments, such a particulate additive may include any organic polymeric material that exhibits a sufficiently high hardness (i.e., a Mohs hardness in the range of at least about 3). Suitable materials may include e.g. particles of melamine-formaldehyde resin, phenolic resin, polymethyl methacrylate, polystyrene, polycarbonate, certain polyesters and polyamides, and the like.

In some embodiments, a scouring body 162 may be made of a material (e.g. a solidified precursor resin) that is sufficiently hard that acceptable scouring performance may be obtained without the presence of a particulate additive. For example, some phenolic resins may provide sufficient hardness, as noted in the Working Examples herein. However, many other polymer resins may be suitable, as will be understood by the ordinary artisan. In general, any of the binder precursors mentioned earlier herein might be considered for use in forming a scouring body 162, as long as the formed binder either exhibits sufficient hardness itself, or is capable of adequately supporting particulate additives that can provide a scouring property. In similar manner to the previously-described binder precursors, a precursor resin used to form scouring bodies 162 may be a thermosetting material or a thermoplastic material, as desired (and may include any filler, additive, processing aid, and the like, as desired for any purpose). Suitable precursor resins may include e.g. the materials described in Examples 21-31 of U.S. Pat. No. 5,227,229 to McMahan McCoy, and the materials described in Example 1 of U.S. Pat. No. 7,393,371 to O'Gary, both of which portions are incorporated by reference herein for this purpose.

As shown in exemplary illustration in FIG. 2, in at least some embodiments a scouring body 162 may comprise an outward portion 166 that protrudes outward beyond first major surface 104 of pad 100. It will be understood that since first major surface 104 is defined mainly by portions of fibers of pad 100 (and occasionally by portions of binder globules), first major surface 104 does not take the form of an actual, physically flat continuous surface. Rather, first major surface 104 (and the later-described second major surface 108) of pad 100 is provided collectively by fiber portions and/or binder globule portions. For the purposes herein, first major surface 104 can be defined as an imaginary plane at which a flat lower surface of a 2 gram, 0.5 $cm^2$ weight comes to rest when placed on the first side (i.e., the upper side with respect to gravity) of pad 100 (between scouring bodies 162 if present) with the pad 100 supported on a flat surface. Such a weight will be sufficient to compress any stray fiber segments that protrude significantly outward beyond the other fibers of pad 100, while not compressing pad 100 to a significant extent. A representative imaginary plane 106 that denotes a first major surface 104 in this manner is shown in illustrative embodiment in FIG. 2. Second major surface 108 may be similarly established. In various embodiments, an outward portion 166 of a scouring body 162 may protrude at least about 0.05, 0.1, 0.2, 0.4, or 0.8 mm outwardly beyond first major surface 104 of nonwoven pad 100. In further embodiments, an outward portion 166 of a scouring body 162 may protrude at most about 2.0, 1.4, 1.2, 1.0, 0.8, or 0.6 mm outwardly beyond first major surface 104 of nonwoven pad 100. Such distances may be measured from the above-described imaginary plane 106, to the outwardmost point of outward surface 168 of body 162, along an axis perpendicular to the major plane of pad 100.

As also shown in illustrative embodiment in FIG. 2, a scouring body 162 may comprise an inward portion 164 that penetrates at least partially into first semi-densified fibrous layer 140 of nonwoven pad 100. Such penetration may allow scouring body 162 to be firmly anchored to pad 100 so that body 162 is not easily dislodged from pad 100 when body 162 is subjected to shear forces that may occur in the scouring process. However, inward portions 164 of scouring bodies 162 typically do not penetrate far into the interior 102 of pad 100. In various embodiments, inward portions 164 of scouring bodies 162 extend inward from first major surface 104, a distance that is less than about 10, 4, 2, or 1% of the overall thickness of nonwoven pad 100.

Advantages Provided by Semi-Densified Fibrous Layer

With various features and functionalities of article 1 having been presented, the advantages imparted by semi-densified fibrous layer 140 can be appreciated. The porous nature of surface 104 and layer 140 can provide that the material that forms scouring body 162 (e.g., a precursor resin) can penetrate at least partially into the interstitial spaces between the fibers (and/or the binder globules) of layer 140, so that body 162 may be more securely anchored in place on pad 100, than would be the case if layer 140 was so heavily densified as to e.g. take the form of a continuous skin. (Scouring body 162 may also be more securely anchored in place than would be the case if layer 140 was e.g. as highly open and porous as interior 102 of pad 100.) Moreover, the presence of fibers and/or binder globules in layer 140 (at a higher density than the density at which they are present in interior 102 of pad 100) can limit the extent to which the material that forms scouring body 162 can penetrate into pad 100. This can ensure that scouring body 162 retains an outward portion 166 (rather than residing too deeply in pad 100), which can provide an advantageous scouring action.

In further detail, it has been found that although the difference in the density at which fibers (and, in some embodiments, binder globules) are present in layer 140 versus the density at which they are present in interior 102 may not necessarily appear to be very large (when e.g. visually inspected with a microscope or when characterized via x-ray microtomography), this small difference unexpectedly has a profound effect on the degree to which scouring bodies 162 protrude outward from pad 100 versus penetrating into pad 100. This has a very significant effect on the function and performance of the scouring bodies. This is documented in FIG. 6, which shows an optical photograph of (on the left) a Working Example scouring article with an array 160 of scouring bodies 162 provided on a nonwoven pad that comprised a semi-densified fibrous layer 140; and (on the right), a Comparative Example scouring article with a similar array of scouring bodies provided on a nonwoven pad that did not comprise a semi-densified fibrous layer. The inventive scouring bodies have outward portions that protrude from the nonwoven pad and are very well defined, whereas the Comparative Example scouring bodies protrude little if at all and are quite poorly defined. The inventive scouring article was found to perform very well in scouring, whereas the Comparative Example article performed less well, as discussed in the Examples.

It was also noted in semi-quantitative testing that the presence of a semi-densified fibrous layer 140 (although not being a continuous skin or even a mostly-continuous skin) could in at least some cases limit the penetration (during scouring) of food residue into the interior 102 of pad 100 and could thus allow such food residue to be more easily removed from pad 100. This can of course increase the usable lifetime of scouring article 1. It is still further noted that the use of a semi-densified fibrous layer as described herein can achieve the above-discussed advantages while preserving other advantages over e.g. a nonwoven pad that is densified throughout its entire thickness. Specifically, the use of a semi-densified fibrous layer allows the nonwoven pad to retain very high flexibility and resiliency, properties that might be adversely affected or lost upon densification of the entire thickness of the pad.

It has been found that in at least some embodiments, at least some portions of at least some scouring bodies 162 may exhibit an outward surface that generally follows a topography established by segments of fibers that provide first major surface 104 of nonwoven pad 100. This phenomenon is illustrated in representative manner in FIG. 4, in which portions of outward surface 168 of body 162 can be seen to exhibit an undulating topography that generally follows the topography established by individual fiber segments (e.g., segments 116) that inwardly underlie those portions of body 162. This varied topography of outward surface 168 (rather than surface 168 being present e.g. as a generally smooth surface) may provide surface roughness that may further enhance the scouring ability of body 162. It will be understood that considerable variation may be present and that any particular body 162 may have a portion that extends outward well beyond major surface 104 of pad 100 (as described earlier herein), and another portion that does not extend as far outward and that displays a topography that echoes that of the underlying fiber segments. It will also be understood that providing a scouring body outward surface that generally follows a topography established by individual fibers and fiber segments of a pad, is distinguished from an arrangement in which an outward surface of a scouring body follows a large-scale structure that is superimposed on any fine structure provided by fiber segments that provide up a major surface of the substrate.

It will be appreciated that exposed lateral edges (e.g., edge 167 as shown in FIG. 2) of bodies 162 may impart an advantageous ability to dislodge e.g. food residue from a food-contacting surface. This is because such exposed lateral edges may have a skiving action when impinged on an item, e.g. on food residue that is adhered to a surface. The advantages of providing scouring bodies as an array of spaced-apart bodies rather than e.g. as a continuous layer, can thus be appreciated. Furthermore, in at least some embodiments a minimum distance between any particular exposed lateral edge of one scouring body, and the exposed lateral edge of a nearest adjacent scouring body, can be specified in order to enhance the scouring ability. In various embodiments, such a minimum distance may be e.g. at least about 1, 2, 3, or 4 mm. It will still further be appreciated that the above-described anchoring of scouring bodies 162 to nonwoven pad 100 may advantageously reduce any tendency for a scouring body 162 to be bodily dislodged (as a whole) from pad 100 during a scouring operation. Rather, this secure anchoring can provide that inward portion 164 of scouring body 162 remains firmly anchored to pad 100 while outward portion 166 of scouring body 162 is gradually worn down with repeated scouring. This can prolong the usable life of scouring article 1. In addition, this gradual removal of outward portion 166 can serve as a wear indicator, particularly if scouring bodies 162 are provided with a contrasting appearance (whether by way of e.g., color, shade, hue, texture, gloss, and so on) from the fibers and/or the binder of nonwoven pad 100. That is, scouring bodies 162 themselves can serve as wear indicators, rather than some separate, additional component having to be included to serve as a wear indictor.

In some embodiments, a semi-densified layer may be present only at one major surface of nonwoven pad 100 (in such embodiments, scouring bodies may be present only on that major surface). As shown in exemplary representation in FIG. 3, in other embodiments monolithic nonwoven pad 100 may comprise a second semi-densified fibrous layer 180 that is integral with the pad 100 and that comprises an outward major surface that provides second major surface 108 of pad 100. (For convenience of presentation, binder globules are omitted from FIG. 3.) Also, second major surface 108 of nonwoven pad 100 may comprise a second array 182 of spaced-apart scouring bodies 184. (Such a scouring article 1 may thus possess double-sided scouring functionality and thus may be reversible.) At least selected scouring bodies 184 may each comprise an inward portion that penetrates at least partially into second semi-densified fibrous layer 180 of pad 100, and an outward portion that protrudes outward beyond second major surface 108 of pad 100. Such a second semi-densified layer 180, and a second array 182 and scouring bodies 184 thereof, may comprise any of the features, properties and/or attributes discussed above with regard to their respective counterparts (first layer 140, first array 160, and scouring bodies 162). These features, properties, and/or attributes will not be repeated here but will be regarded as incorporated by reference at this location.

Second semi-densified fibrous layer 180 may be similar or essentially identical in character (e.g., in porosity, solidity, etc.) to first semi-densified fibrous layer 140. Or, the two semi-densified fibrous layers may differ in character. Similarly, second array 182 and scouring bodies 184 thereof may be alike or different in any desired manner, from first array 160 and scouring bodies 162 thereof. In some embodiments, second array and bodies thereof may be essentially identical to first array 160 and bodies 162 (e.g., within the limitations of actual manufacturing). In other embodiments, bodies 182 may be provided e.g. at a different area coverage and/or spacing, with a different outward-protruding distance, and/or might include a more or less aggressive scouring material than the material of bodies 162. (Such a scouring article may thus possess differential functionality on the two major surfaces.) In some embodiments, a second array 182 of scouring bodies 184 on the second side of a pad 100 may provide enhanced gripping of the second side of the pad while using the first side for scouring (or vice versa).

Monolithic nonwoven pad 100 (in its final form in scouring article 1) may have any useful thickness (as measured between first and second surfaces 104 and 108). In various embodiments, pad 100 may comprise a thickness of at least about 2, 4, 6, 8, 10, 12, 14, or 16 mm. It will be appreciated that pads of such thickness can be distinguished from e.g. thin sheets of sandpaper and the like. In some embodiments, major edges (e.g., edges 190*a-d* as shown in FIG. 1) of pad 100 may be finished edges that (in the forming of article 1) are e.g. crimped or pinched together and then held together by mechanical means, by ultrasonic bonding, and so on. Article 1 may have any suitable number of major edges (e.g., 3, 4, 5, and more) and may have any shape although a four-sided rectangular shape as shown in FIG. 1 may often be convenient. In some embodiments article 1 may be used as made (e.g., in double-sided form as shown in FIG. 3). In other embodiments, one or more layers (e.g., sponge layers, buffing or polishing layers, and so on) may be joined (e.g., laminated) to second major surface 108 of article 1 to form a multilayer laminate. However, even in such embodiments, the previously-discussed requirements that nonwoven pad 100 be a monolithic pad still apply.

It will be appreciated that when monolithic nonwoven pad 100 is in its finished form, the fibers of the pad are held together not merely by melt-bonds between fibers (e.g., between binding fibers 112 and fibers 110), but are also held together by binder globules 120. This results from the fact that binder 120 is distributed throughout nonwoven pad 100 (including the entire interior thereof), as opposed to arrangements in which a binder is coated onto a surface of a pad with little or no penetration into the interior thereof. It thus will be appreciated that in at least some embodiments (e.g. when binder 120 is a thermoset binder), even if nonwoven pad 100 is exposed to a temperature high enough to weaken fiber-fiber melt bonds, this will not allow the fibers to decompress, lengthen, or unfold enough to "rebulk" the pad to a more open and lofty condition (since the fibers are still bonded to each other by the binder). And, even if binder 120 is a thermoplastic binder, in some cases the melting point of such a binder might be e.g. higher than a melting point of the fibers of pad 100; thus, when such a pad is heated it might melt (and e.g. collapse) rather than rebulking. Thus in at least some embodiments (at least some of which embodiments may embrace binders that are thermoplastic as well as binders that are thermoset) monolithic nonwoven pad 100 is not a rebulkable pad nor is it a rebulked pad.

Methods of Using

As mentioned earlier, scouring article 1 is configured such that when first surface 104 of article 1 is contacted with a surface and moved along the surface, scouring bodies 162 may be able to dislodge items (e.g. food residue) that are present on (e.g., adhered to) the surface. In some embodiments, scouring article 1 may be a manually operated article, meaning that it is grasped by hand by the user and moved along a surface by hand. In some embodiments, scouring article 1 may be provided as a disposable/replaceable article that is mounted on a reusable handle or fixture. In some embodiments, scouring article 1 may be mounted on a powered apparatus which apparatus serves to move scouring article 1 along a surface (and/or to rotate scouring article 1) in any suitable manner.

In some embodiments, article 1 may be used to clean food-contacting surfaces. In this context it is noted that "food-contacting" is not limited to surfaces that are specifically designed for intended food contact (e.g., dishes, utensils, pots and pans, and so on). Rather, scouring article 1 may be used to scour surfaces such as cooktops, countertops, surfaces of ovens, and in general any surface onto which food residue may spill. Furthermore, the term "food" is not limited to an edible end product of a food preparation process, but encompasses any material used in the preparation of food (e.g., raw materials, cooking oils, and the like) as well as any material left over from the preparation of food (e.g., char on a cooking surface, and the like). If article 1 is to be used on surfaces that are expected to be at relatively high temperatures when cleaned (e.g., surfaces of grills, griddles, frying pots and the like), the fibers of nonwoven pad 100 (e.g., fibers 110 and 112), binder 120, and scouring bodies 162 may be chosen to have enhanced resistance to such temperatures.

Methods of Making

Monolithic nonwoven pad 100 may be made e.g. by any suitable web-forming process, as long as the thus-formed nonwoven pad can be imparted with a semi-densified fibrous layer as disclosed herein. Potentially suitable web-forming processes include e.g. air-laying, wet-laying, carding, melt-spinning, melt-blowing, stitch-bonding, and so on. In some embodiments, a nonwoven web may be made by air-laying of staple fibers (as performed e.g. by the use of so-called Rando Webber apparatus, commercially available from Rando Machine Corporation, Macedon, N.Y.).

A mass of fibers collected in web-forming process may be processed in any suitable manner to bond at least some fibers of the web to other fibers of the web. In specific embodiments, such fibers may include at least some bonding fibers (whether bicomponent or monocomponent), in which case the collection of fibers can be exposed to heat (whether by passing the collection of fibers through an oven or over a heated roll, or by subjecting the collection of fibers to so-called through-air bonding) and then cooled, to bond at least some fibers together. In such cases, it may be convenient to heat the fibers to a temperature that is near, or above, the aforementioned second melting point of binding fibers, but that is below the aforementioned first melting point of first staple fibers, to perform such a bonding operation. In other cases (e.g. in which most or all of the fibers exhibit a similar melting point), fiber-fiber melt-bonding may still be performed, as long as sufficient control of the heating/cooling process is applied so that sufficient melt-bonding is obtained without causing e.g. large-scale melting of fibers and/or collapse of the fibrous structure. After the bonding operation, the fibers (which in their as-collected state may have had little or no integrity) may now exhibit enough fiber-fiber bonding to have sufficient mechanical strength and integrity to be handled as a self-supporting fiber web or pad.

Such a nonwoven pad may then be processed to form a semi-densified fibrous layer at least at one major surface of the pad; and, a binder may be distributed throughout the pad. While these steps may be performed in any order, it has been found advantageous to form the semi-densified layer and then to distribute the binder, for reasons discussed below. Any suitable process may be used to form a semi-densified fibrous layer. One convenient way to do this has been found to be a heated calendering process, in which a nonwoven pad is passed through a gap between two calendering rolls, at least one of which is a heated roll. Upon appropriate control of process parameters (e.g., roll temperature, gap width, line speed, and so on), in combination with appropriate composition of the nonwoven pad, such a calendering process is able to provide a semi-densified fibrous layer, as detailed in the Working Examples herein.

The ordinary artisan will appreciate that the partial densification of an outermost layer of a nonwoven pad to form a (permanent) semi-densified fibrous layer, as accomplished e.g. by the heat and pressure of a calendering process, may occur e.g. by way of fibers (and binder globules, if present) being moved slightly closer to each other e.g. by mechanical compression, and/or by way of fibers (and binder globules, if present) being slightly agglomerated to form larger fibers and/or binder globules. In some embodiments, the partial densification of layer 140 (and of a second layer 180 if desired) may be accompanied by a significant reduction in the total thickness of web 100. In various embodiments, such a semi-densification process may reduce the total thickness of web 100 by at least about 40, 50, 60, or 70%. In some embodiments, the partial densification of layer 140 (and of a second layer 180 if desired) may reduce the total thickness of web 100 by no more than about 50, 40, 30, 20, or 10%. From the disclosures herein, the ordinary artisan will appreciate that a conventional nonwoven web calendering process, with no particular attention being paid to the web properties and the processing conditions, may not necessarily result in the formation of an integral semi-densified fibrous layer as disclosed herein. Rather, many calendering processes may e.g. significantly reduce the total thickness of a nonwoven pad without causing any preferential increase in density at a surface of the web (or, may produce neither a semi-densified fibrous layer nor a significant reduction in total thickness).

To form a collection of binder globules that are distributed throughout the nonwoven pad (including the entirety of the interior of the pad), one or more binder precursors may be impregnated into the nonwoven pad, and then formed into a binder that provides additional binding of the fibers to each other and further strengthens the pad. Such binder precursors may comprise any suitable flowable composition (as discussed earlier herein) and may be impregnated into the nonwoven pad in any suitable manner. It may be convenient to deliver such a binder precursor in a liquid (e.g. in solution, or as a water-borne latex), which liquid can be impinged onto a major surface of the nonwoven pad by any suitable type of coating (e.g. roll coating), by spraying, and so on. In other embodiments, such a binder precursor might be impregnated into the nonwoven pad in the form of particles. Regardless of the specific type, the binder precursor may then be formed into the binder e.g. by heating to crosslink or polymerize reactive groups in the binder precursor, by heating to drive off water or solvent, by the photoactivation of photoactivatable groups in the binder precursor, and so on.

It has been found that if a semi-densified layer is formed in the nonwoven pad, and a binder precursor is then impregnated into the nonwoven pad from the side of the pad that bears the semi-densified layer, the increased density of fibers in this layer may cause enhanced hold-up (e.g., trapping) of the binder precursor in the semi-densified layer. After the binder precursor is formed into the binder, this can provide that the semi-densified layer contains a higher density of binder (in comparison to the density of binder in the interior of the nonwoven pad) in addition to a higher density of fibers. This can further enhance the degree to which the semi-densified layer can anchor scouring bodies thereon, while maintaining the flexibility of the nonwoven pad. If a nonwoven pad is provided with semi-densified layers at both major surfaces of the pad, it may be advantageous to impregnate the binder precursor into the pad from both major surfaces rather than impregnating the pad only from one major surface.

Scouring bodies can be disposed on the first major surface of the nonwoven pad (and on the second major surface if desired) in any suitable manner. It may be convenient to achieve this by providing a precursor resin that is deposited onto the major surface of the nonwoven pad and is then transformed into a scouring body. Any suitable precursor resin (e.g. in the form of a solvent-borne solution, a solvent-borne emulsion, a water-borne emulsion, a hot-melt coating, and so on) may be used, and may be deposited in any manner that can provide the scouring bodies in a spaced-apart array. For example, coating methods such as e.g. screen-printing may be used. The deposited precursor resin can then be transformed into a scouring body e.g. by heating, by photocuring, and so on, depending on the particular functionality of the precursor resin.

A nonwoven pad bearing an array of scouring bodies on at least one major surface thereof can be formed into a finished scouring article as desired. For example, major edges may be cut (and may be crimped, stitched, etc., as previously mentioned). Scouring articles of any desired size, shape and thickness may thus be obtained. If scouring bodies are provided only on one major surface, a conventional abrasive coating may be provided on the other surface if desired, as described e.g. in the Variation Working Example herein.

LIST OF EXEMPLARY EMBODIMENTS

Embodiment 1 is a scouring article comprising: a monolithic nonwoven pad comprising an interior and a first major surface and a second major surface, the monolithic nonwoven pad comprising: at least some nonwoven fibers that are bonded to each other by fiber-fiber melt-bonding; and, at least some nonwoven fibers that are bonded to each other by a binder that is distributed throughout the monolithic nonwoven pad in the form of globules; wherein the monolithic nonwoven pad comprises a first semi-densified fibrous layer that is integral with the monolithic nonwoven pad and that comprises an outward major surface that provides the first major surface of the monolithic nonwoven pad; and wherein the first major surface of the monolithic nonwoven pad comprises a first array of spaced-apart scouring bodies, at least selected scouring bodies of which first array each comprise an inward portion that penetrates at least partially into the first semi-densified fibrous layer of the monolithic nonwoven pad, and an outward portion that protrudes outward beyond the first major surface of the monolithic nonwoven pad.

Embodiment 2 is the scouring article of embodiment 1 wherein the nonwoven fibers of the pad include first staple fibers that exhibit a first melting point and second staple fibers that include at least one component that exhibits a second melting point that is lower than the first melting point of the first staple fibers, wherein at least selected second staple fibers are melt-bonded to first staple fibers at points of contact between the first and second staple fibers. Embodiment 3 is the scouring article of any of embodiments 1-2 wherein at least some of the nonwoven fibers of the pad are crimped staple fibers. Embodiment 4 is the scouring article of any of embodiments 2-3 wherein at least some of the first staple fibers are polyester fibers. Embodiment 5 is the scouring article of any of embodiments 2-4 wherein at least some of the second staple fibers are chosen from the group consisting of bicomponent binding fibers, monocomponent binding fibers, and blends and mixtures thereof. Embodiment 6 is the scouring article of any of embodiments 1-5 with the proviso that at least substantially all of the nonwoven fibers of the pad are hydrophobic fibers.

Embodiment 7 is the scouring article of any of embodiments 1-6 wherein the at least one binder is a thermoset binder that is derived from a thermosettable binder precursor. Embodiment 8 is the scouring article of any of embodiments 1-7 wherein the at least one binder is derived from a binder precursor that is in the form of a water-borne latex. Embodiment 9 is the scouring article of any of embodiments 1-8 with the proviso that the binder is not a water soluble binder.

Embodiment 10 is the scouring article of any of embodiments 1-9 wherein the at least one binder includes abrasive particles. Embodiment 11 is the scouring article of any of embodiments 1-9 with the proviso that the at least one binder does not include abrasive particles. Embodiment 12 is the scouring article of any of embodiments 1-11 wherein at least selected scouring bodies are each comprised of an organic polymeric resin. Embodiment 13 is the scouring article of embodiment 12 wherein the organic polymeric resin is a phenolic resin. Embodiment 14 is the scouring article of any of embodiments 1-13 wherein at least selected scouring bodies each include abrasive particles. Embodiment 15 is the scouring article of any of embodiments 1-13 with the proviso that the scouring bodies do not include abrasive particles. Embodiment 16 is the scouring article of any of embodiments 1-15 wherein, on average, inward portions of the scouring bodies extend inward from the first major surface of the scouring article a distance that is less than about 10% of the overall thickness of the monolithic nonwoven pad. Embodiment 17 is the scouring article of any of embodiments 1-16 wherein at least selected scouring bodies of which first array each comprise an outward portion that protrudes outward at least 0.2 mm beyond the first major surface of the monolithic nonwoven pad. Embodiment 18 is the scouring article of any of embodiments 1-17 wherein at least selected scouring bodies each possess an outward surface that generally follows a topography established by segments of fibers that provide the first major surface of the monolithic nonwoven pad. Embodiment 19 is the scouring article of any of embodiments 1-18 wherein the first semi-densified fibrous layer exhibits a solidity that is at least about 20% greater than a solidity of the interior of the pad.

Embodiment 20 is the scouring article of any of embodiments 1-19 further comprising a second semi-densified fibrous layer that is integral with the monolithic nonwoven pad and that comprises an outward major surface that provides the second major surface of the monolithic nonwoven pad, and wherein the second major surface of the monolithic nonwoven pad comprises a second array of spaced-apart scouring bodies, at least selected scouring bodies of which second array each comprise an inward portion that penetrates at least partially into the second semi-densified fibrous layer of the monolithic nonwoven pad, and an outward portion that protrudes outward beyond the second major surface of the monolithic nonwoven pad. Embodiment 21 is the scouring article of any of embodiments 1-20 wherein the overall thickness of the monolithic nonwoven pad is at least about 4 mm. Embodiment 22 is the scouring article of any of embodiments 1-21 wherein the monolithic nonwoven pad is an airlaid pad. Embodiment 23 is the scouring article of any of embodiments 1-22 with the proviso that the monolithic nonwoven pad is not a rebulkable pad or a rebulked pad.

Embodiment 24 is a method of scouring a food-contacting surface, comprising manually bringing the first major surface of the scouring article of any of embodiments 2-13 into contact with the food-contacting surface and manually moving the scouring article about the food-contacting surface while maintaining the first major surface of the scouring article in contact with the food-contacting surface.

Embodiment 25 is a method of making a scouring article, the method comprising: providing a monolithic nonwoven pad comprising an interior and a first major surface and a second major surface, the nonwoven pad comprising at least some nonwoven fibers that are bonded to each other by fiber-fiber melt-bonding; forming at least a first semi-densified fibrous layer that is integral with the monolithic nonwoven pad and that comprises an outward major surface that provides the first major surface of the monolithic nonwoven pad; impregnating at least one binder precursor throughout the monolithic nonwoven pad, solidifying the binder precursor into binder globules that are distributed throughout the monolithic nonwoven pad, at least some of which binder globules bind at least some of the fibers of the monolithic nonwoven pad to other fibers of the monolithic nonwoven pad; forming, on the first major surface of the nonwoven pad, a first array of spaced-apart scouring bodies, at least selected scouring bodies of which first array each comprise an inward portion that penetrates at least partially into the first semi-densified layer of the nonwoven pad, and an outward portion that protrudes outward beyond the first major surface of the nonwoven pad. Embodiment 26 is the method of embodiment 25 wherein the forming of the first semi-densified layer is performed before the impregnating of the binder precursor throughout the monolithic nonwoven pad.

EXAMPLES

Test Procedures

Test procedures used in the Examples include the following.

Schiefer Cut Test

Schiefer cut testing is performed in generally similar manner as described in U.S. Pat. No. 5,626,512 to Palaikis, with results reported in grams of material removed (from an acrylic workpiece) per 5000 revolutions.

Wear Test

Wear testing is performed in generally similar manner as described in U.S. Pat. No. 5,227,229 to McMahan McCoy; with differences being that the abrading material is 3M Flexible Diamond Cloth Grade M125 (available from 3M, St. Paul, Minn.), with results reported in grams of material lost (from the tested scouring article) per 100 cycles.

Food Soil Test

Food Soil testing is performed using a metal plate with a blended foodsoil composition baked thereon, in generally similar manner as described in U.S. Pat. No. 5,626,512 to Palaikis. The test is performed manually rather than with the mechanized turntable used by Palaikis. A scouring article to be tested is placed atop the baked-on layer of foodsoil, and gentle manual pressure is applied. The scouring article is moved back and forth in linear fashion across an area of the baked-on foodsoil, with each movement back and forth being one scouring cycle. The number of scouring cycles required to remove enough foodsoil to expose a readily visually discernible area of the metal plate underlying the foodsoil is recorded (the test is terminated at 40 cycles if no metal has been exposed). At least five different human operators perform the testing, with the results being averaged. The results are reported in number of scouring cycles to completely remove foodsoil in a visually discernible area.

Production of Scouring Articles

Web Formation and Bonding

A Representative Working Example airlaid nonwoven web was prepared comprising a blend of 60% 15 denier by 51 mm (length) polyester (PET) type T295 (available from Stein Fibers, LTD. of Charlotte, N.C.), and 40% 6 denier by 51 mm (length) Tairilin Polyester Melty fibers type LML21 (available from Consolidated Fibers of Charlotte, N.C.). The web was formed using a conventional air-laying web forming machine (available from the Rando Machine Company, Macedon, N.Y., under the trade designation "RANDO WEBBER"), targeting a nominal area weight in the range of 200 grams per square meter (gsm). The collected fibers as formed in the Rando-Webber apparatus were supported on a porous belt and passed through a heating apparatus in which hot air (set at 160° C. (320° F.)) was drawn through the thickness of the collected fibers from top to bottom. The belt speed was 1.82 m/min (6 feet/min). This resulted in sufficient fiber-fiber melt bonding that the resultant web was a self-supporting web that could be removed from the belt and subjected to further processing as described below. The thickness of the output web was estimated to be in the range of approximately 43 mm.

Formation of Semi-Densified Fibrous Layers

The Representative Example web was then sent through a smooth steel roll calendering process. The calendar gap was fixed at 50 mils (1.3 mm) at 50 pli (pounds per linear inch), and the top and bottom roll temperature were each set at 154° C. (309° F.). The web was passed thru calender gap at a speed of 2.44 m/min (8 feet/min). The thickness of the resulting calendered web was estimated to be approximately 17 mm. The calendering process preferentially formed a semi-densified fibrous layer at the top surface of the web (as confirmed by optical microscopy e.g. with a confocal microscope, and by x-ray microtomography in which a series of 2-D slices were obtained and were then assembled to produce a volume-rendered 3D portrayal of the calendered web and/or of a scouring article produced therefrom) and a similar semi-densified layer at the bottom surface of the web. In each semi-densified fibrous layer the fibers were present at a higher volumetric density than the fibers in the interior of the web (as could be verified e.g. by cutting a cross-sectional sample of the calendered web). Each semi-densified layer retained its fibrous nature and resembled the layer shown in FIG. 5, except that no binder was present. A Comparative Example web that had not been calendered was retained, which exhibited its original thickness. The Table below compares the calendered Representative Example web to the Comparative Example (uncalendered) web.

| | Comparative Example web | Representative Example web |
|---|---|---|
| Area Weight (grams/m$^2$ ("gsm")) | 214 | 211 |
| Thickness (estimated; mm) | 43 | 17 |

Impregnation of Binder/Densifying Agent

A batch of (non-abrasive) binder precursor mixture was formulated that was generally similar to that described in Example 1 (paragraph 0059) of U.S. Patent Application Publication 20120064324 to Arellano, with the major differences being that the mixture included a crosslinking agent (Cymel 303; Cytec, Woodland Park, N.J.) and a thickener (Methocel; Dow Chemical; Midland, Mich.). A batch of approximately 16 kg was prepared (in a 20 liter container); the viscosity of the mixture was approximately 500 cps.

A standard two-roll coater was used to impregnate the binder precursor into the nonwoven web. The roll coater had an upper rubber backing roll and a lower gravure coating roll. The pressure between the two rolls was 4.2 kg/cm$^2$ (60 psi). The line speed was 4.6 m/min (15.1 feet/min). The web was impregnated from the lower surface (the surface against the gravure roll) under conditions such that the binder precursor penetrated through the entire thickness of the nonwoven web (so that the rubber roll became at least occasionally wetted by through-penetrating binder precursor). The binder precursor-impregnated web was then passed through the above-described heating apparatus (at 4.6 m/min (15.1 feet/min)) in which hot air (set at 182° C. (360° F.)) was drawn through the thickness of the impregnated web to dry and solidify the binder. This impregnation process caused the binder precursor to be impregnated into the entire thickness of the web (although not filling all of the interstitial spaces of the web, of course); the heating process caused the binder precursor to be solidified into binder, providing additional bonding of fibers and enhancing the mechanical integrity of the web. A Comparative Example web (that had not been calendered) was impregnated and heated to form binder, in similar manner.

The Table below compares the calendered, binder-impregnated and dried Representative Example web to the Comparative Example (uncalendered, binder-impregnated and dried) web.

| | Comparative Example web | Representative Example web |
|---|---|---|
| Area Weight (gsm) | 377 | 353 |
| Thickness (mm) | 20 | 21 |

The thus-produced Representative Example web had an appearance similar to the web (another Working Example web) shown in FIG. 5. In inspection of such webs e.g. by optical microscopy, it was noted that the higher volumetric density of fibers in the semi-densified fibrous layers seemed to have resulted in higher hold-up of the binder precursor in the semi-densified layers. The end result appeared to be a higher volumetric density of binder in the semi-densified fibrous layers than in the interior of the web; thus, in this case the preferential providing of binder in these layers appeared to further enhance the semi-densification of these two semi-densified layers in relation to the interior of the web and the binder thus served as a densifying agent. (In the Comparative Example web, which had not been calendered, it did not appear that any such preferential providing of binder in layers near the major surfaces of the web took place; or, it was at most minimal.)

Formation of Scouring Bodies

A batch of abrasive-binder precursor mixture was formulated that was generally similar to that described in Example 1 of U.S. Pat. No. 7,393,371 to O'Gary, with one difference being that the mixture used an abrasive that was grade 120/240 rather than 100/150. Also, the mixture included calcium carbonate (Omycarb; Omya Canada, Perth Ontario, Calif.) and a thickener (Methocel; Dow Chemical; Midland, Mich.), and did not include glycol ether, bentonite clay or amidoamine curing agent. The ingredients were placed into a 20 liter container (to make a batch of approximately 9 kg) and stirred using a pneumatic mixer; the resulting abrasive-binder precursor resin slurry had a viscosity of approximately 11,000 cps.

A standard rotary screen printing apparatus was used to coat the precursor resin onto areas of the surfaces of the nonwoven web. The screen printer used a stencil comprising through-holes in a hash mark screen pattern. The individual through-holes were 1 mm in width by 15 mm in length (due to spreading of the precursor resin slurry, the scouring bodies formed from flowing the slurry through stencil openings of this size were typically in the range of approximately 2.5 mm in width and 16 mm in length). A printing screen (e.g. a fine mesh) was not used.

The hashes were provided as superimposed, offset patterns of first and second square grid arrays, with all the hashes of the first array being oriented parallel to each other along a first direction, and with all the hashes of the second array being oriented parallel to each other along a second direction that was orthogonal to the first direction. (An example of this pattern is found in FIG. 6). For each grid, the center-spacing between nearest-neighbor hashes was 20 mm. The Representative Example Web was sent through the screen printer at a speed of 1.7 m/min (5.6 feet/min) to deposit the precursor resin on a first major surface thereof in the above-described pattern. The web was then passed through the above-described heating apparatus (set at 160° C. (320° F.)) at 1.7 m/min (5.6 feet/min), to solidify the precursor resin to form scouring bodies on the first surface of the web. The web was then flipped over and passed through the screen printer and heating apparatus in similar manner to form scouring bodies on the second surface of the web. This process thus provided a Representative Example scouring article. Scouring bodies were similarly formed on a Comparative Example web that had not been calendered but that had been impregnated with the aforementioned (non-abrasive) binder precursor mixture.

The average measured air pressure drop through the thickness of Representative Example scouring articles (at 85 liters per minute through an area of approximately 102 $cm^2$, corresponding to a face velocity of approximately 13.8 cm/sec) was approximately 0.42 mm of water. This attested that the semi-densified fibrous layers were generally porous rather than e.g. in the form of continuous skins that would have precluded or drastically limited airflow therethrough.

Figure 6:
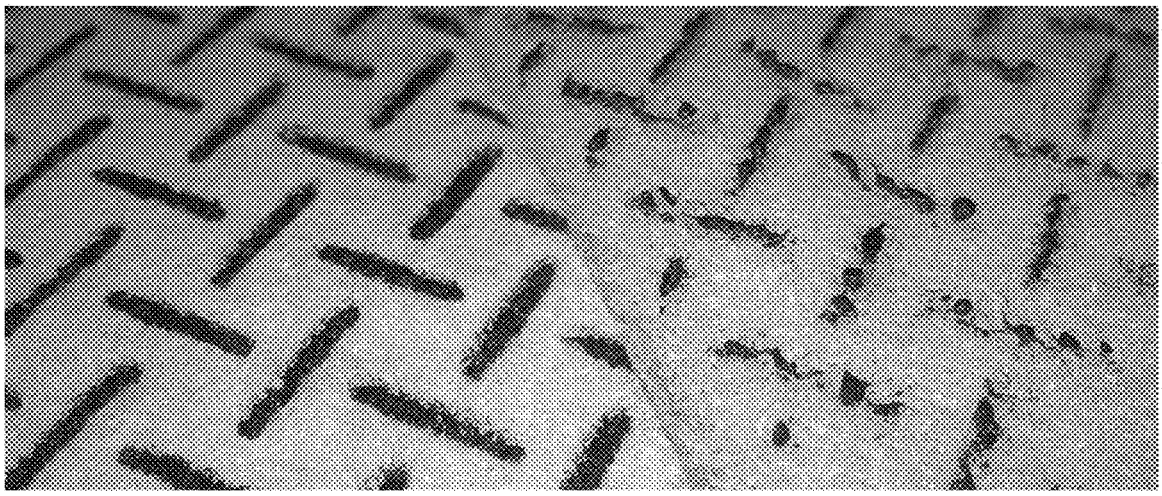
FIG. 6 is an optical photograph of an exemplary Working Example scouring article positioned beside a Comparative Example scouring article.

Numerous duplicates and variations of the above were performed, with generally similar results. In FIG. 6 is shown an optical photograph of a typical Working Example scouring article, positioned next to a Comparative Example scouring article. These data clearly show the enhanced fidelity of the scouring bodies, in the inventive samples.

Performance Testing of Scouring Articles

Various Working Example scouring articles were tested in comparison to above-described Comparative Example scouring articles, and in comparison to commercially available scouring articles available from Sysco, Houston, Tex., under the trade designation Sysco Medium Duty Scour Pad, from Royal Corp., Coatesville, Pa., under the trade designation Medium Duty Green Scouring Pad, and from 3M Company, St. Paul Minn., under the trade designation General Purpose Scouring Pad 96. The following Table shows the results of such testing.

| | Comparative Example | Working Example | Sysco Pad | Royal Pad | Scotch-brite Pad |
|---|---|---|---|---|---|
| Total Wt. (gsm) | 497 | 579 | 612 | 609 | 585 |
| Thickness (mm) | 16 | 15 | 10.5 | 9.9 | 10.9 |
| Schiefer Cut Test | 2.5 | 3.8 | 1.61 | 0.22 | 2.43 |
| Wear Test | 18.5 | 7.8 | 28.4 | 26.1 | 7.2 |
| Food Soil Test | 9.9 | 7.4 | 40+ | 40+ | 17.2 |

In the Table, the Total Weight is the area weight (in gsm) of the scouring article, inclusive of the binder and the scouring bodies. As mentioned, the Schiefer Cut Test is indicative of the ability of a scouring article to remove material from a standard acrylic test workpiece (with higher numbers indicating more material removed by the article); the Wear Test is indicative of the ability of a scouring article to resist being worn down when the scouring article is abraded by a standard abrading material (with lower numbers indicating less wear of the scouring article). The Food Soil Test is indicative of the ability of a scouring article to remove baked-on foodsoil from a test surface (with lower numbers indicating fewer scouring cycles needed to remove the baked-on foodsoil).

Variation Working Example

A Variation Working Example web was prepared in generally similar manner as for the Representative Working Example, with the major difference being that the Variation Example only had scouring bodies formed on a single major surface (referred to for convenience below as a "first" surface) of the web instead of scouring bodies being formed on both major surfaces. In addition, an abrasive slurry was spray-coated onto the other surface of the Variation Example web as described below. The Variation Example was made by the following procedures.

Web Formation and Bonding

A Variation Example airlaid nonwoven web was prepared in generally similar manner as the Representative Example except that the web comprised a blend of 70% 15 denier by 51 mm (length) polyester (PET) type T295 (available from Stein Fibers, LTD. of Charlotte, N.C.), and 30% 4 denier by 51 mm (length) Tairilin Polyester Melty fibers type LML21 (available from Consolidated Fibers of Charlotte, N.C.). A nominal area weight in the range of 190 grams per square meter (gsm) was targeted and the belt speed was 1.52 m/min (5 feet/min). The thickness of the output web was estimated to be in the range of approximately 50 mm (2 inches).

Formation of Semi-Densified Fibrous Layers

The Representative Example web was then sent through a smooth steel roll calendering process. The calendar gap was fixed at 0.38 mm (15 mils) at 7 kg/cm2 (100 psi), and the top roll temperature was set at 146° C. (294° F.) and bottom roll temperature was set at 75° C. (168° F.). The web was passed thru calender gap at a speed of 10.7 m/min (35 feet/min). The thickness of the resulting calendered web was estimated to be approximately 550 mil (14 mm). The calendering process preferentially formed a semi-densified fibrous layer at the top surface of the web (as confirmed by optical microscopy e.g. with a confocal microscope, and by x-ray microtomography; no semi-densified layer was present at the bottom surface of the web.

Impregnation of Binder/Densifying Agent

A batch of (non-abrasive) binder precursor mixture was formulated that was generally similar to that described above for the Representative Example. A two-roll coater was used to impregnate the binder precursor into the nonwoven web, in similar manner to that used for the Representative Example. The binder precursor-impregnated web was then passed through the above-described heating apparatus, which caused the binder precursor to be solidified into binder, providing additional bonding of fibers and enhancing the mechanical integrity of the web.

Formation of Scouring Bodies on One Surface of Web

A batch of abrasive-binder precursor mixture was formulated in similar manner to that described for the Representative Example. A standard rotary screen printing apparatus was used to coat the precursor resin onto areas of a first surface of the nonwoven web, in a hash pattern of the same type used in the Representative Example. The web was then passed through a heating apparatus to solidify the precursor resin to form scouring bodies on the first surface of the web, in similar manner as with the Representative Example.

Spray-Coating of Abrasive Slurry on Other Surface of Web

A batch of abrasive-binder precursor mixture was formulated in similar manner to that used to screen print the scouring bodies in the Representative Example, except that in this case the viscosity was reduced so that the mixture could be easily spray coated. The precursor mixture was coated, using a conventional spray-coating apparatus, onto the other surface (opposite the surface comprising the scouring bodies) of the web and dried in an oven using conventional methods. This resulted in a conventional fibrous abrasive surface similar to that described e.g. in U.S. Pat. No. 2,958,593 to Hoover.

The Area Weight of the finished Variation Example article was 610 gsm. The average measured air pressure drop was approximately 0.17 mm of water. Articles were subjected to testing as described above, with the following results (Schiefer Cut, Wear, and Food Soil tests were all performed on the side of the article comprising the scouring bodies):

| | Variation Example |
|---|---|
| Schiefer Cut Test | 3.7 |
| Wear Test | 6.6 |
| Food Soil Test | 5.6 |

The foregoing Examples have been provided for clarity of understanding only, and no unnecessary limitations are to be understood therefrom. The tests and test results described in the Examples are intended to be illustrative rather than predictive, and variations in the testing procedure can be expected to yield different results. All quantitative values in the Examples are understood to be approximate in view of the commonly known tolerances involved in the procedures used.

It will be apparent to those skilled in the art that the specific exemplary elements, structures, features, details, configurations, etc., that are disclosed herein can be modified and/or combined in numerous embodiments. The present invention may suitably comprise, consist of, or consist essentially of, any of the disclosed or recited elements. As used herein, the term "consisting essentially of" does not exclude the presence of additional materials which do not significantly affect the desired characteristics of a given composition or product. In particular, any of the elements that are positively recited in this specification as alternatives, may be explicitly included in the claims or excluded from the claims, in any combination as desired. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. To the extent that there is a conflict or discrepancy between this specification as written and the disclosure in any document incorporated by reference herein, this specification as written will control.

What is claimed is:

1. A scouring article comprising:

a monolithic nonwoven pad comprising an interior and a first major surface and a second major surface, the monolithic nonwoven pad comprising:

at least some nonwoven fibers that are bonded to each other by fiber-fiber melt-bonding;

and, at least some nonwoven fibers that are bonded to each other by a binder that is distributed throughout the monolithic nonwoven pad in the form of globules;

wherein the monolithic nonwoven pad comprises a first semi-densified fibrous layer that is integral with the monolithic nonwoven pad and that comprises an outward major surface that provides the first major surface of the monolithic nonwoven pad;

and wherein the first major surface of the monolithic nonwoven pad comprises a first array of spaced-apart scouring bodies including particles of melamine-formaldehyde resin, at least selected scouring bodies of which first array each comprise an inward portion that penetrates at least partially into the first semi-densified fibrous layer of the monolithic nonwoven pad, and an outward portion that protrudes outward at least 0.2 mm beyond the first major surface of the monolithic nonwoven pad.

2. The scouring article of claim 1 wherein the nonwoven fibers of the pad include first staple fibers that exhibit a first melting point and second staple fibers that include at least one component that exhibits a second melting point that is lower than the first melting point of the first staple fibers, wherein at least selected second staple fibers are melt-bonded to first staple fibers at points of contact between the first and second staple fibers.

3. The scouring article of claim 2 wherein at least some of the nonwoven fibers of the pad are crimped staple fibers.

4. The scouring article of claim 2 wherein at least some of the first staple fibers are polyester fibers.

5. The scouring article of claim 2 wherein at least some of the second staple fibers are chosen from the group consisting of bicomponent binding fibers, monocomponent binding fibers, and blends and mixtures thereof.

6. The scouring article of claim 1 with the proviso that at least substantially all of the nonwoven fibers of the pad are hydrophobic fibers.

7. The scouring article of claim 1 wherein the at least one binder is a thermoset binder that is derived from a thermosettable binder precursor.

8. The scouring article of claim 1 wherein the at least one binder is derived from a binder precursor that is in the form of a water-bome latex.

9. The scouring article of claim 1 with the proviso that the binder is not a water soluble binder.

10. The scouring article of claim 1 wherein the at least one binder includes abrasive particles.

11. The scouring article of claim 1 with the proviso that the at least one binder does not include abrasive particles.

12. The scouring article of claim 1 wherein, on average, inward portions of the scouring bodies extend inward from the first major surface of the scouring article a distance that is less than about 10% of the overall thickness of the monolithic nonwoven pad.

13. The scouring article of claim 1 wherein at least selected scouring bodies each possess an outward surface that generally follows a topography established by segments of fibers that provide the first major surface of the monolithic nonwoven pad.

14. The scouring article of claim 1 wherein the first semi-densified fibrous layer exhibits a solidity that is at least about 20% greater than a solidity of the interior of the pad.

15. The scouring article of claim 1 further comprising a second semi-densified fibrous layer that is integral with the monolithic nonwoven pad and that comprises an outward major surface that provides the second major surface of the monolithic nonwoven pad, and wherein the second major surface of the monolithic nonwoven pad comprises a second array of spaced-apart scouring bodies, at least selected scouring bodies of which second array each comprise an inward portion that penetrates at least partially into the second semi-densified fibrous layer of the monolithic nonwoven pad, and an outward portion that protrudes outward beyond the second major surface of the monolithic nonwoven pad.

16. The scouring article of claim 1 wherein the overall thickness of the monolithic nonwoven pad is at least about 4 mm.

17. The scouring article of claim 1 wherein the monolithic nonwoven pad is an airlaid pad.

18. The scouring article of claim 1 with the proviso that the monolithic nonwoven pad is not a rebulkable pad or a rebulked pad.

19. A method of scouring a food-contacting surface, comprising manually bringing the first major surface of the scouring article of claim 1 into contact with the food-contacting surface and manually moving the scouring article about the food-contacting surface while maintaining the first major surface of the scouring article in contact with the food-contacting surface.

* * * * *